US010400363B2

(12) United States Patent
Pilar

(10) Patent No.: US 10,400,363 B2
(45) Date of Patent: Sep. 3, 2019

(54) METHOD FOR DEPOSITING A YARN END ON A BOBBIN IN A DEFINED MANNER, A DEVICE AND A SPINNING AND WINDING MACHINE FOR PERFORMING THE METHOD

(71) Applicant: Maschinenfabrik Rieter AG, Winterthur (CH)

(72) Inventor: Evzen Pilar, Litomysl (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 15/811,779

(22) Filed: Nov. 14, 2017

(65) Prior Publication Data

US 2018/0135210 A1 May 17, 2018

(30) Foreign Application Priority Data

Nov. 14, 2016 (CZ) ..... PV 2016-708

(51) Int. Cl.

| | |
|---|---|
| ***B65H 54/26*** | (2006.01) |
| ***B65H 54/28*** | (2006.01) |
| ***B65H 54/34*** | (2006.01) |
| ***B65H 65/00*** | (2006.01) |
| ***D01H 13/04*** | (2006.01) |
| ***D01H 13/16*** | (2006.01) |
| ***D01H 13/26*** | (2006.01) |

(52) U.S. Cl.

CPC ..... *D01H 13/045* (2013.01); *B65H 54/28* (2013.01); *B65H 54/346* (2013.01); *D01H 13/16* (2013.01); *D01H 13/26* (2013.01); *B65H 54/26* (2013.01); *B65H 65/005* (2013.01); *B65H 2701/31* (2013.01); *B65H 2701/311* (2013.01)

(58) Field of Classification Search

CPC ..... B65H 54/26; B65H 54/346; B65H 65/00; B65H 2701/31

See application file for complete search history.

(56) References Cited

U.S. PATENT DOCUMENTS

| | | | | |
|---|---|---|---|---|
| 4,736,898 | A * | 4/1988 | Raasch | B65H 54/34 242/475.7 |
| 4,928,475 | A | 5/1990 | Matsui et al. | |
| 4,948,057 | A | 8/1990 | Greis | |
| 6,044,081 | A | 4/2000 | Oberstrass et al. | |

(Continued)

FOREIGN PATENT DOCUMENTS

| | | |
|---|---|---|
| EP | 1 125 879 A2 | 8/2001 |

OTHER PUBLICATIONS

CZ Search Report, dated Aug. 2, 2017.
EPO Search Report, dated Mar. 12, 2018.

*Primary Examiner* — William E Dondero
(74) *Attorney, Agent, or Firm* — Dority & Manning, P.A.

(57) ABSTRACT

A method for depositing a yarn end of a yarn on a bobbin wound on a tube in a defined manner during winding of yarn on the bobbin at a workstation of a spinning and winding machine includes detecting the yarn end on the bobbin via an attending device. After detecting the yarn end, the yarn end is passed to devices at the workstation, and with the devices at the workstation, the yarn end is directed in a defined manner outside of a profile of a standard yarn package wound on the bobbin prior to the yarn end being deposited onto the tube outside of the yarn package profile.

5 Claims, 1 Drawing Sheet

(56) References Cited

U.S. PATENT DOCUMENTS

| | | | | |
|---|---|---|---|---|
| 6,505,791 | B1 | 1/2003 | Syndikus et al. | |
| 2007/0175199 | A1* | 8/2007 | Badiali ..... | B65H 54/26<br>57/22 |
| 2008/0283655 | A1 | 11/2008 | Henze et al. | |

* cited by examiner

METHOD FOR DEPOSITING A YARN END ON A BOBBIN IN A DEFINED MANNER, A DEVICE AND A SPINNING AND WINDING MACHINE FOR PERFORMING THE METHOD

TECHNICAL FIELD

The invention relates to a method for depositing a yarn end on a bobbin in a defined manner during winding yarn on a bobbin at a workstation of a spinning and winding machine. The yarn end is deposited on a tube on which, prior to being deposited in a defined manner outside the profile of a standard yarn package, the yarn end is detected by the means of an attending device and is then deposited on the tube in a define manner outside of the profile P of a standard yarn package.

The invention also relates to a device for depositing a yarn end on a bobbin in a defined manner during winding yarn on a bobbin at a workstation of a spinning and winding machine, which comprises a yarn guide of a traversing device of yarn, mounted so as to be movable reciprocatingly along the width of the bobbin, the yarn guide reciprocatingly movable in a controlled manner to the area outside of the profile P of the standard yarn package.

The invention further relates to a spinning and winding machine comprising a row of workstations arranged next to each other, wherein each workstation comprises a winding device of yarn before which is arranged a traversing device of yarn comprising a reciprocating traversing guide of yarn movable along the width of the bobbin, the yarn guide reciprocatingly movable in a controlled manner to the area outside of the profile P of the standard yarn package.

BACKGROUND

Depositing a yarn end on a bobbin in a defined manner after terminating the winding process is one of the conditions for the subsequent processing of the yarn wound on the bobbin, especially from the point of view of finding the yarn end easily on the bobbin for further yarn processing. As a matter of fact, when winding is being terminated on the respective bobbin, several last windings of the yarn are wound on the tube of the bobbin being wound immediately next to the standard package at the end of the bobbin. The end portion of the yarn and the yarn end is deposited from the edge of the standard yarn package by winding obliquely towards the other end of the standard package directly across the surface of the standard package.

A number of methods and devices are known to perform this. However, their common disadvantage is the complexity of the design and the need for special embodiments of elements, e. g., by means of an attending device which is movable along a row of workstations.

An aim of the invention is to eliminate or at least minimize the disavantages of the background art, especially to allow depositing the yarn end on a bobbin in a defined manner by using simple means, and preferably, by using the means of a workstation of a spinning and winding machine or by using the existing means of a workstation to the maximum possible extent.

SUMMARY OF THE INVENTION

The aim of the invention is achieved by a method for depositing a yarn end on a bobbin in a defined manner, whose principle consists in that after detecting the yarn end on the bobbin, the yarn is passed to the means of a workstation with the aid of which the yarn is subsequently directed and deposited on a tube outside the profile of a standard yarn package.

The advantage of this solution is to maximize the use of the existing means of a workstation of a spinning and winding machine and to simplify the design of an attending device, whether it is an air jet spinning machine or a rotor spinning machine, or a winding machine, etc.

Additional objects and advantages of the invention will be set forth in part in the following description, or may be obvious from the description, or may be learned through practice of the invention. The principle of the device for depositing a yarn end on a bobbin in a defined manner during winding yarn on a bobbin at a workstation of a spinning and winding machine consists in that the yarn guide is adapted to assume the yarn before depositing the yarn end on the tube of the bobbin at a region outside the profile P of the standard package on the bobbin.

The principle of the spinning and winding machine comprising a row of workstations arranged next to each other, wherein each workstation comprises working devices and a winding device of yarn before which is arranged a traversing device of yarn comprising a reciprocating traversing guide of yarn movable along the width of the bobbin, consists in that the working devices and the yarn guide are adapted to assume the yarn from the attending device before depositing the yarn end on the tube outside the profile P of the standard package on the bobbin.

DESCRIPTION OF DRAWINGS

The invention is schematically represented in the drawings, where.

DETAILED DESCRIPTION

Figure 1:
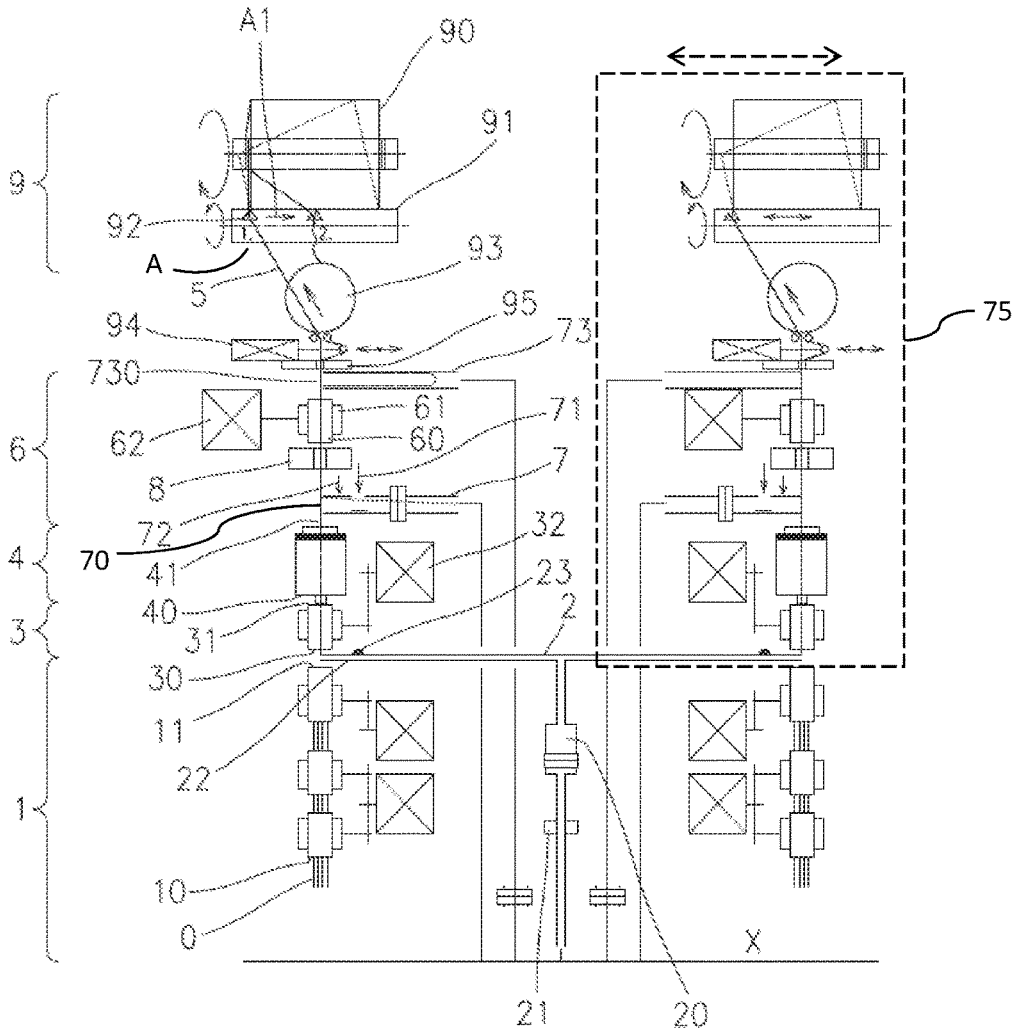
FIG. 1 shows a pair of workstations of an air jet spinning machine, which are arranged next to each other.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

A spinning and winding machine comprises at least one row of adjacent workstations, each of which contains the same working means and nodes. Such a spinning and winding machine is, for example, an air jet spinning machine or a rotor spinning machine, or a winding machine, etc., which may have a different design in certain respects, but for the use of the present invention they are provided with corresponding working means.

The invention will be described in detail with reference to an exemplary embodiment of a workstation of an air-jet spinning machine and a rotor spinning machine, which comprises at least one row of identical workstations arranged next to each other.

In the illustrated embodiment, pairs of workstations arranged next to each other are shown, whereby the workstations in the specific embodiment share some of the elements, in particular the elements which are used for resuming spinning at the workstation and which will be briefly described in the following. In an unillustrated embodiment, each workstation is provided with non-shared working means.

Along a row of workstations is moveably mounted an attending device, which is provided with a system of working means for carrying out the working operations at the workstations being attended.

An illustrated embodiment of a workstation of an air jet spinning machine comprises a drafting mechanism 1 of sliver 0, whose inlet opening 10 is aligned with an unillustrated source of sliver and whose outlet opening 11 is aligned with the inlet opening 30 of a fiber feeding device 3.

The fiber feeding device 3 is coupled to a drive 32 and its outlet opening 31 is aligned with the inlet opening 40 of fibers to a spinning nozzle 4. In the spinning nozzle 4, the entering sliver 0 is transformed into the yarn 5, which is drawn off from the nozzle 4 by a drawing-off mechanism 6 arranged downstream the yarn outlet opening 41 from the spinning nozzle 4.

An unillustrated embodiment of the workstation of the rotor spinning machine includes a feeding device of the fiber sliver which is the input part of the rotor spinning unit, in which a spinning rotor is situated, and fibres singled-out from the sliver are fed into the spinning rotor, in which they are formed into yarn 5. The yarn 5 is drawn out by the drawing-off mechanism 6 arranged behind the outlet of yarn 5 from the rotor spinning unit.

The drawing-off mechanism 6 comprises a pair of rollers 60, 61, which are pressed to each other, one of which is coupled to a rotary drive 62 and the other rotatably mounted on an unillustrated pressure arm, which is swingingly mounted in the structure of the workstation.

Between the outlet opening 41 of the spinning nozzle 4 and the yarn drawing-off mechanism 6, or in a rotor spinning machine between the outlet of yarn 5 from the rotor spinning unit and the drawing-off mechanism 6 of yarn 5, a suction opening 70 of a suction tube 7 is assigned to the working path of the yarn 5, the suction tube 7 being connected in a controllable manner to a source X of vacuum. In the suction tube 7 are arranged a device 71 for interrupting the yarn 5 and a device 72 for passing the yarn 5 end to the nozzle 4, or to the spinning rotor.

Between the suction tube 7 and the yarn drawing-off mechanism 6 is arranged a sensor 8 of the quality of yarn 5, which is connected to the control systems of the workstation and/or to the control systems of a section of workstations and/or of the machine.

A yarn winding device 9 on the bobbin 90 is arranged in the path of yarn 5 downstream of the yarn drawing-off mechanism 6. During winding, the bobbin 90 lies on a drive cylinder 91 which drives the bobbin 90 by rolling, the yarn 5 being traversed across the width of the bobbin 90 by a guide 92 of a yarn traversing device. In the illustrated embodiment, before passing through the traverse guide 92, the yarn passes through a waxing device 93. In the case of conical bobbins being wound, before the waxing device is in the yarn 5 path arranged a compensator 94 of yarn loops which arise periodically during winding the yarn on the conical bobbins 90. In the yarn path, before the compensator 94 is arranged a sensor 95 of the yarn 5 presence, which during the yarn production operates in the mode of a yarn break detector.

A vacuum reservoir of yarn 73 is aligned by its suction inlet opening 730 with the yarn 5 path between the sensor 95 of the yarn 5 presence and the yarn drawing-off mechanism 6. The vacuum reservoir of yarn 73 is connected to a vacuum source X.

In the illustrated embodiment for resuming of spinning at the workstation of an air-jet spinning machine, the mouth 22 of a yarn guide channel 2 is arrangeable in the space between the outlet opening 11 of the sliver drafting mechanism 1 and the inlet opening 30 of the sliver feeding device 3, whereby the mouth 22 is, during the normal spinning operation, either completely moved outside the space between the outlet opening 11 of the sliver drafting device 1 and the inlet opening 30 of the sliver feeding device 3, or it is rigid and is situated outside the path of the sliver 0. The guide channel 2 is with its other end connected to the vacuum source X. The guide channel 2 is at a distance from its mouth 22 provided with a device 20 for the preparation of the spinning-in end of yarn. The guide channel 2 is provided with a sensor 21 of the yarn 5 presence in the guide channel 2 in the direction away from the mouth 22 of the guide channel 2 downstream of the device 20 for the preparation of the spinning-in end of yarn.

In the illustrated example of embodiment of an air jet spinning machine, a securing element 23 (keeper) of the free yarn 5 end is arranged in the space between the inlet opening 30 of the sliver feeding device 3 and the device 20 for the preparation of the spinning-in end of yarn 5 in the guide channel 2, or it is arranged between the inlet opening 40 of the spinning nozzle 4 and the device 20 for the preparation of the spinning-in end of yarn 5 in the guide channel 2. In the illustrated embodiment, the securing element 23 (keeper) of the free yarn 5 end is part of the mouth 22 of the guide channel 2.

The invention works in a such manner that the yarn 5 being produced is wound on the bobbin 90, whereupon after the complete winding of the required length of the yarn 5 on the bobbin 90 the bobbin 90 is removed from the machine and sent off for further processing.

Since it is essential for the yarn 5 end to be detected relatively easily on this wound bobbin 90 when starting further processing, a defined reserve of yarn 5 is formed before the complete termination of winding the yarn 5 being produced on the bobbin 90, the yarn 5 reserve being deposited on the tube of the bobbin 90 outside the profile P of the standard (main) package. This is always performed on the same side of the tube of the bobbin 90, when the yarn end is deposited at the defined position for further processing.

This process of depositing the yarn 5 end on the bobbin 90 (a tube with a package) in a defined manner is performed according to the invention in such a manner that spinning is terminated and the yarn 5 end is wound on the bobbin 90, and so at first it is necessary to detect the yarn 5 end on the bobbin 90. The attending device 75 (depicted schematically by the dashed line representation in FIG. 1) approaches the respective workstation and detects by its means the end 50 of yarn on the bobbin 5. The respective means of the attending device include, e.g., a suction nozzle, which is displaceably arranged on the attending device and connected in a controlled manner to the vacuum source. After the end 50 of yarn 5 is detected on the bobbin 90 by the means of the attending device 75, the yarn is passed by the attending device to the means of the respective workstation, whereby the yarn 5 is guided to the working path of yarn 5 between the yarn drawing-off mechanism 6 from the spinning nozzle 4, or from the spinning unit of a rotor spinning machine, and the yarn winding device 9 and, at the same time, the yarn 5 is inserted between the drawing-off rollers 60, 61 of the winding device 6. As a result, the yarn 5 at the workstation is prepared for the subsequent steps of depositing the yarn 5 end on the tube of the bobbin 90 in a defined manner outside the profile P of the standard (main) package.

Subsequently, a sufficiently long yarn 5 reserve is formed for depositing the yarn 5 end 50 on the bobbin 90 in a defined manner outside the profile P of the standard package, namely by depositing the yarn 5 reserve to a suitable reservoir of yarn 5 or simultaneously to several reservoirs of yarn 5 at the workstation and/or in the means of the attending device.

The yarn 5 reserve formation is carried out, e.g., by sucking the yarn 5 into the suction tube 7, which is situated in the direction away from the winding device 9 below the yarn drawing-off mechanism 6, whereby the yarn 5 reserve formation itself is performed by unwinding the yarn 5 from the bobbin 90 by means of reverse rotation of the bobbin 90 in the winding device 9 and by means of reverse rotation of the drawing-off mechanism 6, through which the yarn 5 constantly passes and by which the yarn 5 is drawn off in the reverse manner from the bobbin 90, i.e., the yarn 5 reserve formation is carried out while the winding device 9 and the drawing-off mechanism 6 rotate against the direction in which they rotate during continuous spinning, i.e. during the normal production of yarn 5. During this process of unwinding the yarn 5 from the bobbin 90 the yarn is according to the requirements acted upon by the compensator 94 of yarn loops 5, which in case of need regulates possible yarn 5 tension fluctuations, thereby improving unwinding the yarn 5 for the purpose of forming the yarn 5 reserve for depositing the yarn 5 end on the bobbin 90 in a defined manner. In the case of the yarn reserve formation in the means of the attending device, this process is similar, the only difference being that the yarn 5 reservoir is located on the attending device. Optionally, the yarn 5 reserve for depositing the yarn 5 end on the bobbin in a defined manner after the controlled stopping of the workstation is formed in the vacuum reservoir 73 analogically to the process described above.

After forming the yarn 5 reserve, the yarn 5 is prepared for depositing the yarn 5 end on the bobbin 90 in a defined manner outside the profile P of the standard package. This takes place according to the invention in such a manner that the yarn 5 on the working path at the respective workstation passes through the yarn guide 92 of the traversing device of yarn 5 across the width of the bobbin 90, or, if necessary, the yarn 5 is situated in the path which intersects the working path of the yarn guide 92 of the yarn traversing device across the width of the bobbin 90. Owing to the fact that the place where the yarn 5 is deposited on the bobbin 90 outside the profile P of the standard package has a considerably smaller diameter than is the diameter of the standard package on the bobbin 90, it may happen due to the geometry of the winding device that the yarn 5 does not intersect the path of the guide 92 of yarn 5 of the yarn traversing device across the width of the bobbin 90, and, consequently, the yarn guide 92 of the traversing device cannot capture the yarn 5 for depositing the end 50 of yarn 5 on the bobbin 90 in a defined manner outside the profile P of the standard package. To solve this situation, a rectifying means of the yarn path is mounted at the workstation or on the attending device. The rectifying means of the yarn path makes it possible for the yarn 5 to intersect the path of the yarn guide 92 of the traversing device across the width of the bobbin 90 and the yarn guide 92 deposits the yarn 5 end 50 on the bobbin 90 in a defined manner outside the profile P of the standard package. In another unillustrated embodiment, the above-mentioned rectifying means is such that it enables to keep/lock the yarn 5 in the yarn guide 92 of the traversing device during depositing the yarn 5 end on the bobbin 90 in a defined manner outside the profile P of the standard package.

Figure 2:
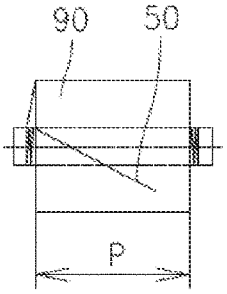
FIG. 2 shows the yarn end deposited on the bobbin in a defined manner.

Subsequently, the actual process of depositing the yarn 5 end 50 in a defined manner on the bobbin 90 outside the profile P of the standard package is started, which consists in that the winding device starts to rotate in the same direction as during winding in the standard production of yarn 5 and the yarn guide 92 of the traversing device moves aside across the width of the bobbin 90 outside the profile P of the standard package of yarn 5 on the bobbin 90, as is indicated in FIG. 1 by the position A of the guide 92. As a result, at the same time, the yarn 5 reserve, which has been deposited in a respective reservoir or reservoirs, begins to be consumed. Due to the rotation of the bobbin 90 and moving of the guide 92, it is either all the yarn 5 reserve or its substantial part that is wound here, i.e., outside the profile P of the standard package of yarn 5 on the bobbin 90. If it is required that the yarn 5 end itself is deposited on the surface of the standard package of yarn 5 on the bobbin 90, then at a defined moment, e.g., as soon as the yarn 5 end from the formed reserve of yarn 5 passes through the sensor 95 of the yarn 5 presence, the yarn guide 92 of the traversing device moves across the width of the bobbin 90 in the direction A1 towards the opposite end of the bobbin 90, by which means the end portion of yarn 5 with the end of yarn 5 is continuously deposited on the surface of the standard package of yarn 5 towards the opposite end of the package on the bobbin 90, as can be seen in FIG. 2. Since the bobbin 90 keeps rotating, the end portion of the yarn 5 with the end of yarn 5 is deposited onto the surface of the standard package on the bobbin 90 obliquely with respect to the longitudinal axis of the bobbin 90. The start of the final movement of the yarn guide 92 of the yarn traversing device across the width of the bobbin 90 depends on the speed of the rotation of the bobbin 90, i.e., of the winding device 9 and on the geometrical arrangement of a system made up of the winding device 9, the guide 92, and the sensor 95 of yarn 5, which determines the function of the speed and duration of the movement of the yarn 5 end 50 from the sensor 95 of yarn to the guide 92.

Furthermore, it is advantageous if during depositing the yarn 5 on the tube of the bobbin 90 outside the profile P of the standard package of yarn 5 the yarn 5 is acted upon by the compensator of yarn 5 loops and/or by air suction and/or by the drawing-off mechanism of yarn 5 from the spinning unit and/or by a yarn braking device, by which means it is possible to maintain the tension of the yarn 5 when being deposited on the tube (on the bobbin 90) outside the profile P of the standard package of yarn 5.

Modifications and variations can be made to the embodiments illustrated or described herein without departing from the scope and spirit of the invention as set forth in the appended claims.

The invention claimed is:

1. A method for depositing a yarn end of a yarn on a bobbin wound on a tube in a defined manner during winding of yarn on the bobbin at a workstation of a spinning and winding machine, the method comprising:

detecting the yarn end on the bobbin via an attending device; and after detecting the yarn end, passing the yarn to devices of the workstation; and with the devices of the workstation, directing the yarn end in a defined manner outside of a profile of a standard yarn package wound on the bobbin prior to the yarn end being deposited onto the tube outside of the profile of the standard yarn package.

2. The method according to claim 1, wherein after passing the yarn to the devices of the workstation, a yarn reserve is formed at the workstation for use in the depositing of the yarn end on the tube outside the profile of the standard yarn package.

3. The method according to claim 1, wherein during the depositing of the yarn on the tube outside the profile of the standard package of yarn, the yarn is acted upon by one or more of a compensator of yarn loops, air suction, a yarn drawing-off mechanism, or a yarn braking device, by which yarn tension is maintained during depositing the yarn on the tube outside the profile of the standard yarn package.

4. The method according to claim 1, wherein after depositing the yarn on the tube outside the profile of the standard yarn package, the yarn end is deposited onto the surface of the standard yarn package on the bobbin by movement of a yarn guide in a direction towards an opposite end of the bobbin.

5. The method according to claim 4, wherein one or both of termination of depositing the yarn on the tube outside the profile of the standard yarn package or start of the movement of the yarn guide in the direction towards the opposite end of the bobbin is initiated by passage of the yarn end through a yarn presence sensor.

* * * * *